US006733053B2

(12) United States Patent
Hodge et al.

(10) Patent No.: US 6,733,053 B2
(45) Date of Patent: May 11, 2004

(54) TRASH CONTAINER LOCKING APPARATUS AND METHOD

(75) Inventors: Allan M. Hodge, San Diego, CA (US); Anthony A. Hodge, San Diego, CA (US)

(73) Assignee: Hodge Products, Inc., El Cajon, CA (US)

( * ) Notice: Subject to any disclaimer, the term of this patent is extended or adjusted under 35 U.S.C. 154(b) by 0 days.

(21) Appl. No.: 10/260,508

(22) Filed: Sep. 27, 2002

(65) Prior Publication Data

US 2004/0061341 A1 Apr. 1, 2004

(51) Int. Cl.[7] ..... E05B 3/00

(52) U.S. Cl. ..... 292/336.3; 292/DIG. 30; 292/DIG. 11; 292/285

(58) Field of Search ..... 292/DIG. 30, 336.3, 292/281, 285, 286, 282, DIG. 11; 70/20, 31; 285/148.19, 32; 16/110.1, 436; 220/315

(56) References Cited

U.S. PATENT DOCUMENTS 3,011,666 A * 12/1961 Dempster et al.
3,315,828 A * 4/1967 Dubo
3,687,317 A * 8/1972 Gagel
3,709,389 A * 1/1973 Steltz
4,155,584 A * 5/1979 Pracchia
4,182,530 A * 1/1980 Hodge ..... 294/68.26
4,198,087 A * 4/1980 Cornell et al. ..... 292/246
4,424,740 A * 1/1984 Gwathney
4,520,945 A * 6/1985 Hodge ..... 220/315
4,955,501 A * 9/1990 Hodge
5,015,021 A * 5/1991 Wyson et al.
5,025,721 A * 6/1991 Spiers
5,029,724 A * 7/1991 Serio
5,042,856 A * 8/1991 Goodman
5,085,341 A * 2/1992 Hodge
5,090,753 A * 2/1992 Goodman
5,094,358 A * 3/1992 Serio, Sr.
5,094,487 A * 3/1992 Drewry
5,118,000 A * 6/1992 Howell et al.
5,135,129 A * 8/1992 Joly
5,149,153 A * 9/1992 Drewry et al.
5,201,434 A * 4/1993 DeVivo
5,213,382 A * 5/1993 Dawdy
5,224,743 A * 7/1993 Dawdy et al. ..... 292/228
5,224,744 A * 7/1993 Michelutti
5,415,314 A * 5/1995 McCollum
5,419,598 A 5/1995 Kreitzer
5,474,341 A 12/1995 Putman
5,599,050 A 2/1997 Tinsley
5,662,364 A 9/1997 Reeb et al.
5,683,126 A 11/1997 De Vivo et al.
5,738,395 A * 4/1998 Probst ..... 292/230
5,772,061 A 6/1998 Lowe
5,772,264 A 6/1998 Bettenhausen
5,997,052 A 12/1999 Reeb et al.
6,267,260 B1 * 7/2001 Lyons ..... 220/212.5
6,290,093 B1 9/2001 Obriot et al.
2002/0078720 A1 * 6/2002 Watts ..... 70/38 A

* cited by examiner

*Primary Examiner*—Robert J. Sandy
(74) *Attorney, Agent, or Firm*—Gordon & Rees LLP

(57) ABSTRACT

A locking apparatus for releasably securing the lid of a trash container in a closed position has a locking arm with an elongate central portion and bent end portions pivotally mounted on opposite side walls of the container for movement between a first position in which the central portion extends across a front wall of the container and a second position in which the central portion extends over the lid to hold it closed. The central portion is initially adjustable in length to accommodate different size containers. The arm is lockable in both the first and the second position.

16 Claims, 2 Drawing Sheets

TRASH CONTAINER LOCKING APPARATUS AND METHOD

BACKGROUND OF THE INVENTION

The present invention relates to a trash container locking apparatus and method for a trash container or bin.

Owners of commercial or large size trash bins as used for businesses, stores, apartments, and the like often experience difficulty in preventing unauthorized use of the bins. Costs are increased by unauthorized individuals dumping trash in the bins. In view of this, various locking systems have been proposed in the past for preventing dumping of trash in such bins by unauthorized individuals. However, such locking systems often make it difficult for authorized users to gain access to the bin, and also cause difficulty to refuse collectors.

Some trash bins have automatic locks which release when the bin is inverted to dump trash, but re-lock automatically when the bin is returned to an upright position and the lid is closed. This is hazardous to children who may be playing in the area, as well as homeless individuals. It has been known for homeless individuals to enter a trash bin at night if the lid is left open, and then to become locked in the bin after the lid is closed. There is also a risk that children may become accidentally locked in such bins while playing.

U.S. Pat. No. 5,213,382 of Dawdy et al. describes a locking mechanism for a refuse container which has a locking bar pivotally attached to the container and movable between a locked position preventing opening of the container lid and an open position in which it is rotated out of the way of the lid. When a locking fixture on the mechanism is engaged, the locking bar cannot be manually pivoted, but it can be pivoted by the force of a collection truck boom. The lock may be disengaged by a key allowing manual pivoting of the locking bar into the open position. U.S. Pat. No. 5,029,724 of Serio describes a U-shaped locking member which is pivoted to the side walls of a container. The member pivots over the lid in order to lock the lid closed. A locking mechanism holds the U-shaped member in this position.

Other trash bin locking systems are known which involve a bar pivotally mounted on the container and rotatable between a position extending over the lid to hold it closed, and a position rotated down against the front wall of the container, leaving the lid free to open. The bar is normally locked by a padlock or the like in the closed position. A problem with such a system is that the bar pivots freely when released, such that when the bin is inverted to dump trash into a trash truck, the bar will tend to drop down and get in the way of the lid or the trash itself. Also, such a system is still subject to the risk of homeless individuals entering the bin to sleep if the lid is left open, and then closing the lid. Authorized individuals may then rotate the bar over the lid and lock it in place, trapping the person in the trash bin.

Another problem with bar locking systems is that trash bins come in various sizes, so that the bars must be custom-made for the specific containers or must be adjustable to accommodate different container sizes. In one known system, separate left and right arms are provided for pivotally mounting on opposite side walls of a trash container adjacent the lid and the front end wall. One of the arms has an opening for alignment with a padlock holder when rotated into a locked position. The on-site installer must first attach the arms to the opposite ends of the container, and then cut a pipe to the desired length for spanning the front wall of the container between the free ends of the two arms. At that point, the pipe must be welded to the arms. This is a fairly labor intensive process which is subject to error. It also has the problem that the pipe will be free to flop around, potentially catching on the lid and preventing it from opening, when the container is inverted in order to dump trash.

SUMMARY OF THE INVENTION

It is an object of the present invention to provide a new and improved locking apparatus and method for a trash container.

According to one aspect of the present invention, a locking apparatus for releasably securing the lid of a trash container is provided, which comprises an arm having a central portion and first and second coplanar end portions each bent perpendicular to the central portion, first and second pivot brackets for mounting on opposite side walls of a trash container adjacent an open, upper end of the container, each pivot bracket having a pivot pin for pivotally connecting the respective end portion to the bracket, whereby the arm is rotatable between a first, open position in which the central portion extends across a front wall of the container and a second, locked position in which the end portions extend upwardly and the arm extends over a lid closing the open upper end of the container, the central portion having an adjustable length for spanning the front wall of different size containers.

In an exemplary embodiment, a locking device is provided for locking the arm in the second position. This may comprise a flange projecting from one end portion which engages through an opening in a locking plate for mounting on the respective side wall of the container, the flange having an opening for receiving a padlock for locking the arm in the locked, second position. Additionally, a second locking device may be provided for locking the arm in the first, open position. The arm end portion will have a second lock flange suitably positioned to project through an opening in a second locking bracket or plate positioned on the container side wall when the arm is rotated into the open position. The same padlock may then be used to lock the arm in the open position.

In this way, the lock arm is locked in either the open or the closed position. When locked in the open position, it will not be free to pivot when the container is inverted in order to dump trash into a trash truck, so that it will not impede this process. After the trash is dumped, the operator will not be able to rotate the arm back into the closed or locked position until they have opened and removed the padlock, making it more likely that they will remember to re-lock the arm in the closed position. This will help to prevent unauthorized dumping of trash, and will also prevent children or homeless individuals from entering the container and potentially becoming imprisoned there accidentally. The padlock may be of the type which will not release the key unless the padlock is re-locked, such that the trash truck driver will necessarily have to re-lock the arm in order to retain his or her key. The same will be true of authorized users of the trash container, making it less likely that they will forget to re-lock the arm in position after use.

The pivot brackets may comprise U-shaped bars, with one end welded to the container, and a pivot pin secured between the opposite ends of the bar. The arm may be made of metal pipe, which the pipe ends are flattened and provided with openings which are pivotally engaged over the respective pivot pins between the ends of the U-shaped pivot brackets.

This provides better support for the pivot attachment, and also provides for some free play of the locking arm by sliding back and forth along the respective pivot pins. In prior art pivot attachments which have no such free play, jamming or binding of the arm may occur if it is deformed or bent as a result of impacts, which tend to happen fairly frequently in trash dumping operations.

In an exemplary embodiment of the invention, the central portion of the arm is divided into two halves, each half having an end, and a central sleeve into which the end of each half of the arm extends. This allows for telescopic adjustment of the length of the central portion when the apparatus is installed on a container. Once the central portion is at the correct length for spanning the front wall of the container, the two halves of the arm are welded at the adjusted position in the sleeve. In an alternative arrangement, the central portion may be split into two halves, with the end of one half being of larger diameter, and the end of the other half telescopically engaged in the end of the first half. The provision of the arm or pipe in two or more pieces will also facilitate shipping of the apparatus.

According to another aspect of the present invention, a method of locking a trash container is provided, which comprises:

- pivotally mounting a locking arm adjacent the front end wall and upper end opening of a trash container such that the arm can be pivoted between a first open position extending across the front end wall and a second position extending across the closed lid of the container to prevent opening of the lid;
- providing a first locking device for locking the locking arm in the first, open position;
- providing a second locking device for locking the locking arm in the second position;
- engaging the first locking device to lock the arm in the open position in order to dump trash from the container, whereby the lid is free to open when the container is inverted; and
- engaging the second locking device to lock the arm in the second position when the container is returned to the upright position and after trash is dumped in the container.

The locking apparatus of this invention will reduce the risk of individuals accidentally being locked in a trash container, since users of the container will be more likely to lock the arm in the closed position. Additionally, locking of the arm in the open position will avoid the problem of a free swinging lock bar impeding the trash dumping operation when the container is inverted by a trash truck. The overall apparatus is relatively simple to install and inexpensive.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
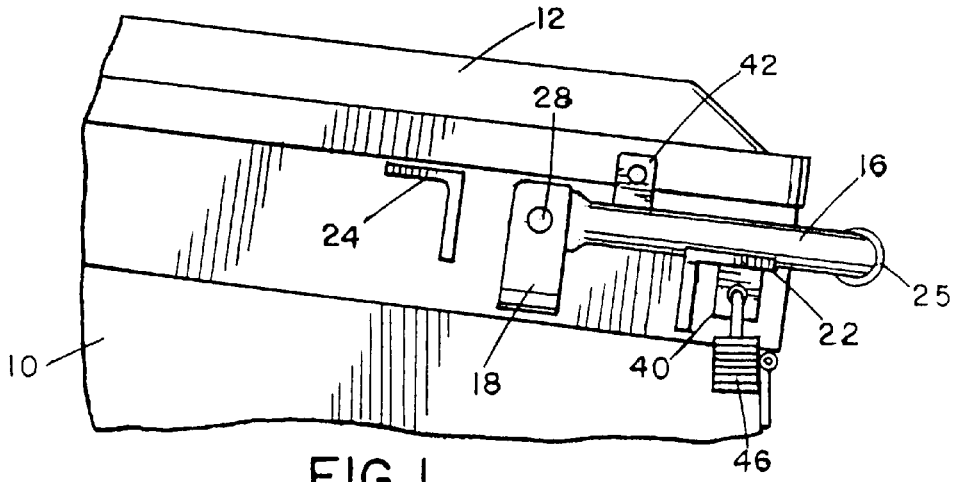
FIG. 1 is a side view of a portion of a trash container showing the locking apparatus according to an exemplary embodiment of the invention in the open and locked position.

FIGS. 1 to 6 illustrate a trash container locking apparatus according to an exemplary embodiment of the invention installed at the front end of a trash container 10 adjacent the upper end opening of the container, with the lid 12 of the container shown in the closed position. The apparatus basically comprises an arm or pipe 14 having an elongate central portion and opposite end portions 16 bent perpendicular to the central portion, with the end of each portion 16 pivotally mounted in a respective pivot mounting bracket 18 mounted on the respective opposite side walls 20 of the container. First and second locking plates 22,24 are provided on one side wall 20 for providing end stops to allow the arm 14 to be locked in the open position of FIGS. 1 to 3 and the closed and locked position of FIGS. 5 and 6, respectively, as will be described in more detail below.

Arm 14 is a metal pipe of round or square tubing in the illustrated embodiment, although it may be a solid bar or the like in alternative embodiments. The diameter of arm 14 is of the order of 0.5 inches to 1 inche, with the diameter being 0.75 inches in an exemplary embodiment. In the illustrated embodiment, the arm is split into two halves at the center of the central portion, with the end of each half telescopically engaged in the respective ends of a central sleeve 25. This is to allow for adjustment of the overall length of the central portion when the arm is installed on a trash container, so that it can be readily adapted to containers of different widths. Once the central portion length has been adjusted and the pivot brackets 18 secured to the side walls, the two halves of the pipe can be suitably welded to the opposite ends of sleeve 25.

Figure 2:
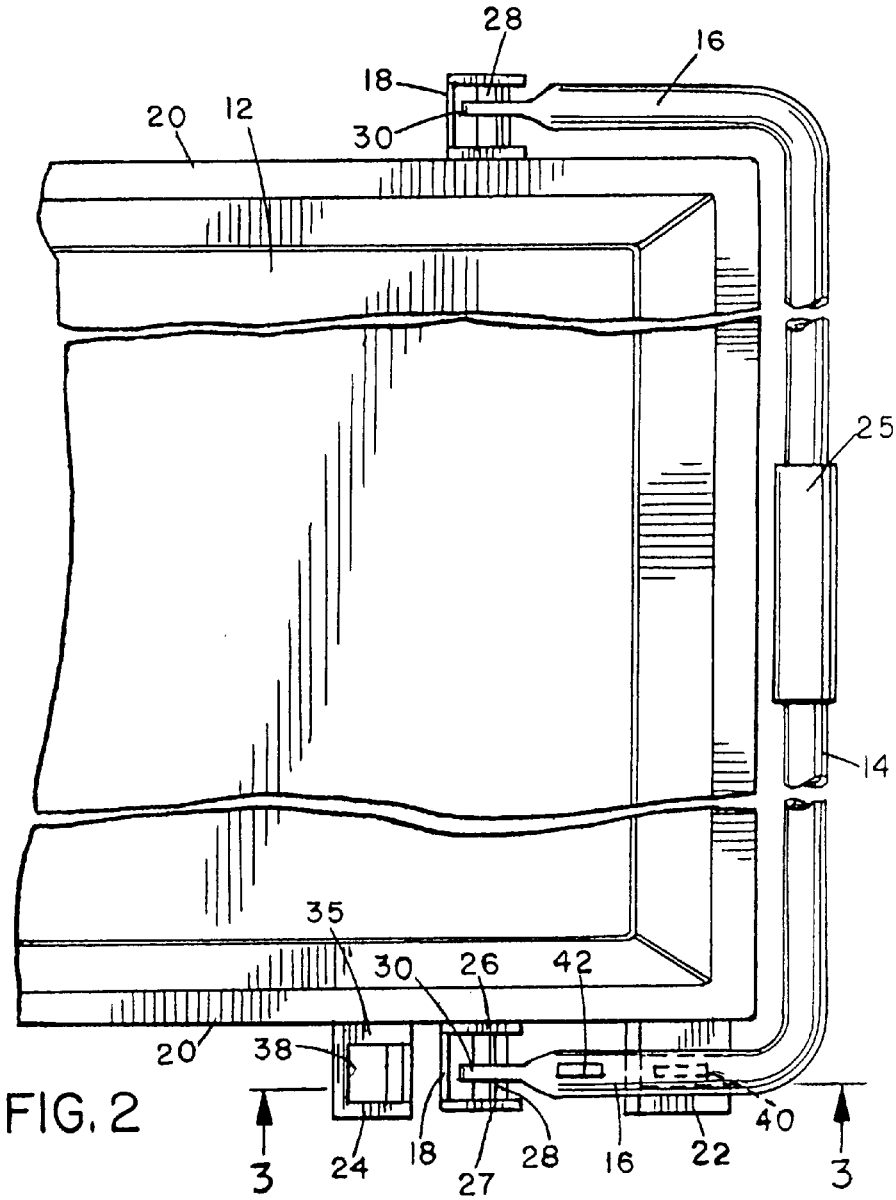
FIG. 2 is a top plan view of the structure of FIG. 1.
Figure 3:
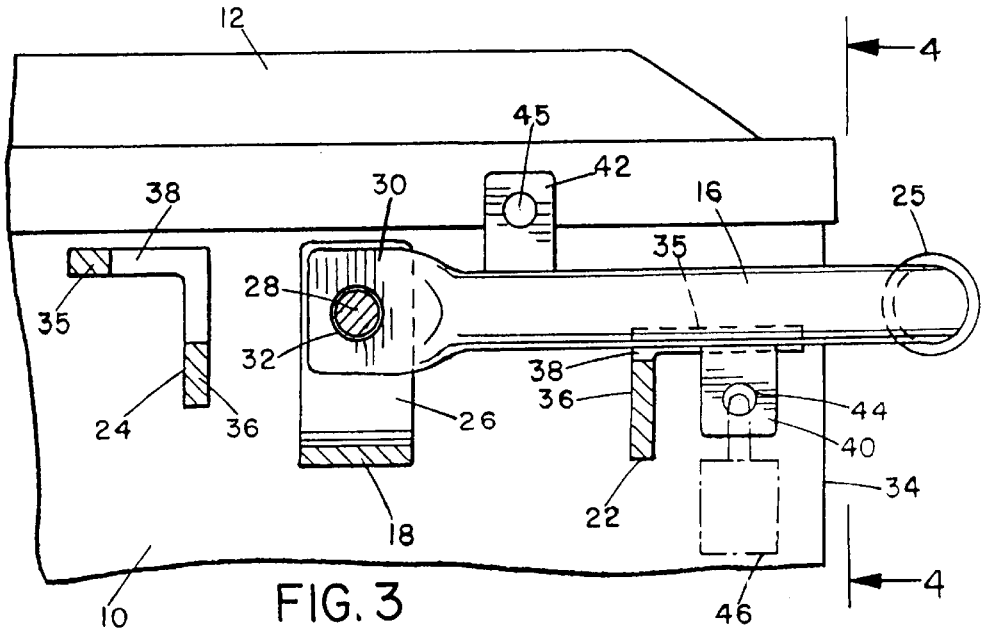
FIG. 3 is an enlarged sectional view taken on line 3—3 of FIG. 2.
Figure 4:
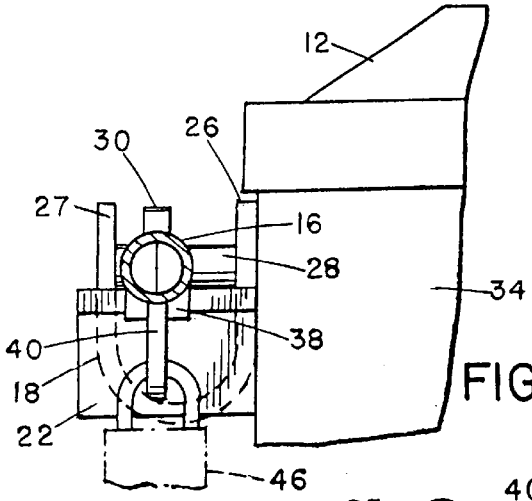
FIG. 4 is a sectional view taken on line 4—4 of FIG. 3.

The two pivot brackets 18 are supported on the outside of the container, unlike some prior art arrangements in which pivot pins extend through the container side walls. Each bracket comprises a U-shaped bracket member with opposite ends 26,27, as best illustrated in FIG. 2 and 4. A pivot pin 28 extends between the ends 26,27 of each pivot bracket. The pivoted end 30 of each end portion 16 of the pipe or arm 14 is flattened and provided with a hole 32 which is pivotally engaged over the respective pin 28, as illustrated in FIG. 2 and 3. The arrangement is such that the ends 30 are free to slide along the length of pin 28 between the bracket ends 26 and 27, so that the arm is less likely to deform or bend on impacts, and less likely to jam or become non-pivotable if it is deformed. In an exemplary embodiment, each pivot pin 28 was at least 0.25 inches longer than necessary to provide for free play of the ends 30 along the pins 28 to preclude or reduce the risk of binding if the arm becomes deformed by impact at a later date.

Figure 6:
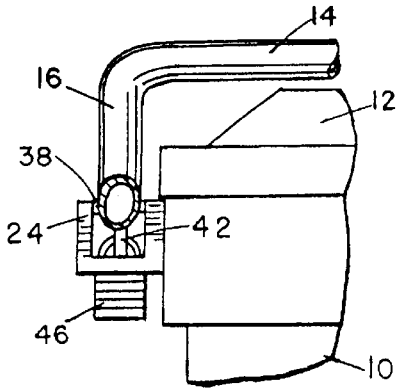
FIG. 6 is a sectional view taken on line 6—6 of FIG. 5.
Figure 5:
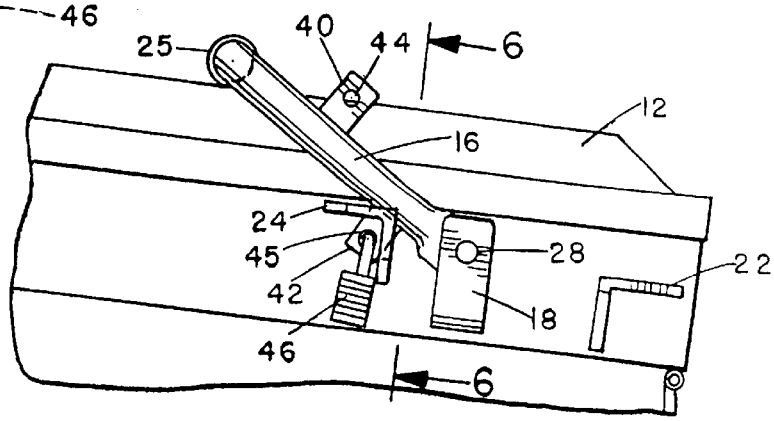
FIG. 5 is a view similar to FIG. 1, but showing the mechanism in the closed and locked position.

The two locking end plates 22,24 mounted on one side wall 20 of the container are positioned to define a first, open position of the arm 14 in which the central portion of the arm extends across the front wall 34 of the container, as illustrated in FIGS. 1 to 3, and a second position of the arm 14 in which the end portions 16 extend generally upwardly and rearwardly and the central portion extends across the closed lid 12 of the container, as illustrated in FIGS. 5 and 6. Each end plate is an angle bar having first and second perpendicular arms 35,36 and a through slot 38 spanning the corner between the arms, as best illustrated in FIGS. 2 and 3. The plates 22,24 are suitably secured to the side wall of the container by welding or the like on opposite sides of the pivot bracket 18 so that they face away from one another with each arm 35 horizontal and arm 36 extending vertically.

The end portion 16 of the locking arm 20 at the same side of the container as plates 22,24 has a downwardly projecting locking flange 40 and an upwardly projecting locking flange 42 spaced from flange 40, as best illustrated in FIG. 3. Each flange has a lock opening 44,45, respectively. When the arm 14 is in the open position illustrated in FIGS. 1 and 3, the end portion 16 will rest on the horizontal arm 35 of the end locking plate 22. In this position, the downwardly projecting flange 40 projects through the slot 38 in end plate 22 with the opening 44 located in the space between the arms 35,36. The shackle of a padlock 46 may then be inserted through opening 45 and locked closed. This will prevent movement of the arm 14 from the open position, so that the lid 12 of the container may be freely opened and closed.

When the padlock is released, arm 14 may be rotated in an anti-clockwise direction from the open position of FIG. 3 into the closed position of FIG. 5, in which locking flange 42 extends through the slot 38 of locking end plate 24 and the central portion of the arm 14 extends across the top of the closed lid of the container. In this position, the shackle of padlock 46 can be inserted through opening 45, as illustrated in FIGS. 5 and 6, and locked in the closed position. This will prevent movement of the arm 14 from the closed and locked position. The padlock 46 is of the type in which the key is retained until the shackle is re-closed and locked, so that a user can only retrieve their key by re-closing the padlock.

Operation of the locking apparatus will now be described in more detail. The apparatus will be supplied in separate parts for installation on a trash container of any dimensions. The parts are arm 14, which can be shipped in three separate parts, comprising the two halves and sleeve 25, the two U-shaped pivot brackets 18 and pivot pins, and the two end locking plates 22,24, and the padlock 46. In order to install the apparatus, the two pivot brackets are secured to the opposite side walls 20 of the container at the appropriate position such that the central portion of the arm can extend across the front wall of the container with some free play, and can extend over the top of the lid of the container when closed. The brackets may be secured by welding, bolts, or other fasteners. The length of the central portion is adjusted and the two halves of the arm are then welded to the opposite ends of the adjustment sleeve 25. The end position locking plates 22,24 are then secured to one side wall 20 at the appropriate position for receiving the locking flanges 40,42 when the arm 14 is in the first, open position or the second, locked position, respectively. The apparatus is now installed and ready to use. Although the arm is locked on one side of the container only in the illustrated embodiment, locking plates 22, 24 may also be installed on the opposite side wall for added support, if desired. Locking flanges 40, 42 may also be provided on both end portions 16 of the arm 14, so that the arm may be selectively locked at either or both ends.

Each authorized user of the container, as well as the trash pick up personnel, will be provided with a key for padlock 46. Normally, the lid of the container will be closed, and the arm will be locked in the closed position of FIGS. 5 and 6. When an authorized user wishes to place some trash in the container, they unlock the padlock 46 and rotate the arm into the open position, resting on the end lock plate 22. The lid can then be opened. Since the user's key will be retained in the padlock, the user is motivated to close the lid and rotate the arm back into the closed and locked position, returning the padlock to the position illustrated in FIG. 5 and 6 and locking it in order to release their key. The angle bar shape of each end locking plate will help to protect the padlock and will also prevent unauthorized individuals from using cutting tools to cut the shank of the padlock 46.

When a trash truck arrives in order to dump trash from the container 10, the operator or driver will first unlock the padlock 46, rotate the arm into the open position of FIGS. 1 to 4, and lock the arm in this position. They can then activate the truck arms to lift the container and invert it in order to allow the lid to swing open and any trash in the container to be dumped into the truck. The pivoted arm will be held in the open position during this process, preventing it from swinging down and impeding the trash dumping operation. The container is then returned to its upright position. Should the truck driver forget to close the container lid and re-lock the arm over the lid, there will still be no hazard to children playing or homeless people, since the arm is locked open and cannot be moved over the lid to hold it closed. The only way it can be moved is for an authorized user to unlock the padlock 46 and release the arm so that it can be rotated up and locked over the closed lid, which they are unlikely to do when there is a person inside the container.

In the past, homeless individuals or children playing would sometimes enter a trash container, and then move the lid into the closed position. This would not be a problem normally, since it would still be possible to move the lid aside in order to exit the container. However, an unlocked, pivoted locking bar could potentially be rotated over the lid in such situations, and even locked in place, by someone unaware of the presence of an individual inside the container. It has been known for an individual to be actually dumped from a container into a trash truck in such situations, which is very hazardous. The locking system of this invention reduces the risk of such accidental locking of individuals into trash containers, since the trash truck operators will lock the arm in the open position in order to dump trash, so that it cannot subsequently be rotated over the closed lid of the container unless the operator or another unauthorized individual actually unlocks the padlock, at which point they cannot retrieve their key unless they re-engage the padlock, presumably with the arm locked in the closed position. This will make it impossible for children or homeless people to enter the container.

By making the locking arm from two pieces of pipe with the pipe ends inserted into a central sleeve, the arm can be readily adjusted to span the width of any trash container on the market today, even double or more width containers with more than one lid. In an exemplary embodiment, both end portions 16 of the arm will be provided with locking flanges 42,40, so that the arm may be locked on the right or left side of the container, at the preference of the installer. The end portions 16 of the arm may also be made adjustable in length in order to accommodate trash bin lids of different thicknesses.

The locking apparatus of this invention is of relatively simple and inexpensive construction, and is designed such that it must be intentionally locked in both the open and closed positions, rather than automatically locking closed. This reduces the risk of individuals accidentally becoming locked in the container. Locking of the arm in the open position also avoids the problem of the free swinging arm potentially swinging into the lid as the trash container is inverted over a trash truck, or preventing trash from being properly dumped out of the container.

Although an exemplary embodiment of the invention has been described above by way of example only, it will be understood by those skilled in the field that modifications may be made to the disclosed embodiment without departing from the scope of the invention, which is defined by the appended claims.

We claim:

1. A locking apparatus for releasably securing the lid of a trash container, comprising:

a locking arm having an elongate central portion having opposite ends and first and second coplanar end portions each formed integrally with the respective ends of the central portion and bent perpendicular to the central portion;

first and second pivot brackets for mounting on opposite side walls of a trash container adjacent an open, upper end of the container, each pivot bracket having a pivot pin for pivotally connecting the respective end portion of the arm to the bracket, whereby the arm is rotatable between a first, open position in which the central portion extends across a front wall of the container and a second, locked position in which the central portion extends over a lid closing the open upper end of the container;

the central portion having an adjustable length for spanning the front wall of different size containers; and the central portion and end portions of the arm being made from tubular pipe, the bent end portions of pipe having flattened ends each having a through hole pivotally engaged over a respective pivot pin.

2. A locking apparatus for releasably securing the lid of a trash container, comprising:

a locking arm having an elongate central portion and first and second coplanar end portions each bent perpendicular to the central portion:

first and second pivot brackets for mounting on opposite side walls of a trash container adjacent an open, upper end of the container, each pivot bracket having a pivot pin for pivotally connecting the respective end portion of the arm to the bracket, whereby the arm is rotatable between a first, open position in which the central portion extends across a front wall of the container and a second, locked position in which the central portion extends over a lid closing the open upper end of the container;

the central portion having an adjustable length for spanning the front wall of different size containers; and each pivot bracket having opposite end walls, the pin extending between the end walls, and each end portion of the arm having an end with an opening pivotally engaged over the pin, the pivot pins being of predetermined length to provide a clearance between the arm ends and the bracket end walls, whereby the arm ends are slidable along the length of each pivot pin.

3. A locking apparatus for releasably securing the lid of a trash container, comprising:

a locking arm having an elongate central portion and first and second coplanar end portions each bent perpendicular to the central portion;

first and second pivot brackets for mounting on opposite side walls of a trash container adjacent an open, upper end of the container, each pivot bracket having a pivot pin for pivotally connecting the respective end portion of the arm to the bracket, whereby the arm is rotatable between a first, open position in which the central portion extends across a front wall of the container and a second, locked position in which the central portion extends over a lid closing the open upper end of the container;

the central portion having an adjustable length for spanning the front wall of different size containers; and each pivot bracket comprising a U-shaped member and the pivot pin extending between the ends of the member, one end of the member being secured to the respective side wall of the container and the other end being spaced outwardly from the container side wall.

4. The apparatus as claimed in claim 1, wherein a locking assembly is provided for locking the arm in the second position.

5. The apparatus as claimed in claim 4, wherein:

a second locking assembly is provided for locking the arm in the first position.

6. A looking apparatus for releasably securing the lid of a trash container, comprising:

a locking arm having an elongate central portion and first and second coplanar end portions each bent perpendicular to the central portion;

first and second pivot brackets for mounting on opposite side walls of a trash container adjacent an open, upper end of the container, each pivot bracket having a pivot pin for pivotally connecting the respective end portion of the arm to the bracket, whereby the arm is rotatable between a first, open position in which the central portion extends across a front wall of the container and a second, locked position in which the central portion extends over a lid closing the open upper end of the container;

the central portion having an adjustable length for spanning the front wall of different size containers;

a first locking assembly for locking the arm in the second position;

a second locking assembly for locking the arm in the first position; and at least one end portion of the arm having a first locking flange projecting in one direction and a second locking flange spaced from the first locking flange and projecting in the opposite direction, the first locking assembly comprising a first locking plate mounted on the side wall of the container and having a first opening for receiving the first locking flange when the arm is in the second, locked position, and the second locking assembly comprising a second locking plate mounted on the side wall of the container and having a second opening for receiving the second locking flange when the arm is in the first, open position, each flange having a hole for releasable engagement with a lockable member for holding the arm in the respective end position.

7. The apparatus as claimed in claim 6, wherein the lockable member comprises a padlock and a key for releasing the padlock.

8. The apparatus as claimed in claim 7, wherein the key is retained in the padlock unless the padlock is in a locked condition.

9. The apparatus as claimed in claim 1, wherein the arm comprises a first member made in two parts, each part comprising an end portion and part of the central portion, and a second member comprising a central sleeve having opposite ends, each part having an end telescopically engaged in a respective end of the sleeve for adjustment of the length of the central portion of the arm.

10. The apparatus as claimed in claim 1, wherein the arm is made from at least two separate parts which are telescopically engaged in the central portion of the arm, whereby the length of the central portion may be adjusted.

11. A locking apparatus for releasably securing the lid of a trash container, comprising:

a locking arm having an elongate central portion and first and second coplanar end portion each bent perpendicular to the central portion;

first and second pivot brackets for mounting on opposite side walls of a trash container adjacent an open, upper end of the container, each pivot bracket having a pivot pin for pivotally connecting the respective end portion of the arm to the bracket, whereby the arm is rotatable between a first, open position in which the central portion extends across a front wall of the container and a second, closed position in which the end portion extend upwardly and the central portion extends over a lid closing the open upper end of the container;

a first locking assembly for releasably locking the arm in the first, open position;

a second locking assembly for releasably locking the arm in the second, closed position; and the first and second locking assemblies comprising first and second locking plates, respectively, for mounting on a respective side wall of the container adjacent the first and second position of the arm, each locking plate having an opening, and first and second locking flanges projecting from the respective end portion of the arm for engagement through the respective openings in the locking plates when the arm is in the respective first and second positions, each locking flange having a hole for engagement with a padlock to lock the flange against withdrawal from the locking plate.

12. The apparatus as claimed in claim 11, wherein each locking assembly is key operated.

13. The apparatus as claimed in claim 11, wherein each locking plate is an angle member having first and second perpendicular arms.

14. A method of locking a trash container, comprising:

pivotally mounting a locking arm adjacent the front end wall and upper end opening of a trash container such that the arm can be pivoted between a first open position extending across the front end wall and a second position extending across the closed lid of the container to prevent opening of the lid, the locking arm having an elongate central portion of adjustable length having opposite ends and first and second coplanar end portions each formed integrally with the respective ends of the central portion and bent perpendicular to the central portion, the central portion and end portions of the arm being made from tubular pipe;

providing a first locking device for locking the locking arm in the first, open position;

providing a second locking device for locking the locking arm in the second position;

engaging the first locking device to lock the arm in the open position in order to dump trash from the container, whereby the )id is free to open when the container is inverted;

engaging the second locking device to lock the arm in the second position when the container is returned to the upright position and after trash is dumped in the container; and the step of pivotally mounting the arm on a container comprising adjusting the length of the central portion to span the width of the front wall of the container, pivotally securing the end portions to respective pivot pins at selected positions on the respective opposite side walls of the container such that the central portion can extend across the front end wall of the container with some free play, and securing the central portion of the arm at the adjusted length, the bent end portions of pipe having flattened ends each having a through hole engaged over a respective pivot pin.

15. A lockable trash bin assembly comprising:

a trash container having a front wall, a rear wall, opposite side walls, and an open upper end;

at least one lid on said trash container movable between an open position out of the way of the open upper end and a closed position closing the upper end of the trash container;

a pivot bracket secured at a predetermined position on each side wall of the container;

an arm having an elongate central portion with opposite ends and opposite, coplanar end portions formed integrally with respective ends of the central portion and each bent at a right angle to the elongate central portion, the arm being made of metal pipe, and each end portion being pivotally mounted on a respective one of the pivot brackets such that the arm is pivotable between a first, open position in which the end portions extend forwardly and the central portion extends across the front wall of the container and a second, lid locking position in which the central portion extends across the lid of the container in the closed position; at least one locking assembly for locking the arm in the second, lid locking position; and the central portion of the arm being of adjustable length for accommodating trash containers of varying width; and each pivot bracket having opposite end walls and a pivot pin extending between the end walls, and the pipe having flattened ends each having an opening pivotally engaged over a respective one of the pivot pins with some free play to allow movement of the flattened end along the length of the pin.

16. The trash bin assembly as claimed in claim 15, including a second locking assembly for locking the arm in the first, open position.

* * * * *